United States Patent [19]

Instance

[11] Patent Number: 4,850,612

[45] Date of Patent: Jul. 25, 1989

[54] LABELS AND MANUFACTURE THEREOF

[76] Inventor: David J. Instance, Guinea Hall, Sellindge, Kent, United Kingdom

[21] Appl. No.: 127,276

[22] Filed: Dec. 1, 1987

[30] Foreign Application Priority Data

Dec. 2, 1986 [GB] United Kingdom ..... 8628779

[51] Int. Cl.[4] ..... B42D 19/00; B42D 1/00; B65D 27/10; B65D 65/28

[52] U.S. Cl. ..... 281/5; 281/2; 229/69; 428/43

[58] Field of Search ..... 281/1, 2, 5; 282/1, 282/2, 3, 12, 11.5 R, 25, 27; 229/68, 69, 74, 927; 206/610, 632; 40/122; 428/181, 121, 40, 43

[56] References Cited

U.S. PATENT DOCUMENTS

| | | | |
|---|---|---|---|
| 1,924,909 | 8/1933 | Brown | 40/7 |
| 3,883,069 | 5/1975 | Volkert | 229/69 |
| 4,023,727 | 5/1977 | Tess | 229/69 |
| 4,199,630 | 4/1980 | Consiglio | 229/69 |
| 4,637,633 | 1/1987 | Instance | 281/5 |
| 4,699,833 | 10/1987 | Instance | 428/43 |

FOREIGN PATENT DOCUMENTS

| | | |
|---|---|---|
| 0180365 | 10/1985 | European Pat. Off. . |
| 1475304 | 6/1973 | United Kingdom . |
| 1475706 | 6/1977 | United Kingdom . |
| 2127378 | 9/1982 | United Kingdom . |
| 2127778 | 9/1984 | United Kingdom . |

OTHER PUBLICATIONS

European Search Report re EP 87 31 0581.

*Primary Examiner*—Frank T. Yost
*Assistant Examiner*—Paul M. Heyrana, Sr.
*Attorney, Agent, or Firm*—Bernard, Rothwell & Brown

[57] ABSTRACT

A label for attachment to a product, the label comprising a longitudinal strip which is divided into a row of pairs of panels by a plurality of transverse fold lines and a longitudinal fold line, the strip having a transverse weakened tear line which extends across a second pair of panels, the strip being folded about the transverse fold lines such that the first pair of panels is covered by the remaining pairs of panels and then about the longitudinal fold line so that those panels which are one one side of the longitudinal fold line cover the panels which are on the other side of the longitudinal fold line; a layer of adhesive which adheres together the two opposed parts of the second pair of panels which are between the weakened tear line and that transverse fold line which is between the first and second pair of panels; and a support web to which one panel of the first pair is adhered so that the said one panel and the other panel of the first pair form a back cover and a front cover respectively for the remaining panels which are enclosed therebetween, and the remaining panels being removable from the front and back covers through the free transverse edge of the front and back covers by tearing along the weakened tear line.

6 Claims, 1 Drawing Sheet

LABELS AND MANUFACTURE THEREOF

BACKGROUND OF THE INVENTION

The present invention relates to a label for attachment to a product and to a method of producing labels.

It is frequently desirable to be able to attach a sheet of printed instructions to a product, and to avoid soiling of the sheet during handling of the product or loss of the sheet during such handling, it is desirable that the sheet should be enclosed in an envelope and held from falling out. If the means for holding the sheet can be made such as to require a non-repeatable action to remove the sheet from the envelope, they will afford an indication of unathorised tampering.

British Pat. No. 1,475,304 and British Patent Specification No. 2115744 each disclose a sheet and envelope arrangement which is formed from a single fold sheet. When the sheet and envelope arrangement is attached to a product, the sheet can be removed from the envelope by tearing along a line of perforations. However, those arrangements suffer from the disadvantage that the folding of the sheet to form the final sheet and envelope is relatively complicated. In addition, the sheet requires to be die-cut from a larger sheet since the sheet is provided with cuts or cut-outs. The die-cutting operation must be carried out on individual sheets and this renders it difficult to produce the labels in a continuous process since the die-cutting step is a separate process step. This tends to reduce the rate of production of the labels and accordingly increases the unit cost of the labels.

The present invention relates to a label in which a sheet portion is enclosed between a front cover and a back cover and can be removed by tearing along a weakened tear-line. The folding of a longidutinal strip to form the sheet portion and the front and back covers is less complicated than in the prior art referred to above. Also, the strip does not require cuts or cut outs which in the prior art are produced by die-cutting.

SUMMARY OF THE INVENTION

Accordingly, the present invention provides a label for attachment to a product, the label comprising a longitudinal strip which is divided into a row of pairs of panels by a plurality of transverse fold lines and a longitudinal fold line, the strip having a transverse weakened tear line which extends across a second pair of panels, the strip being folded about the transverse fold lines such that the first pair of panels is covered by the remaining pairs of panels and then about the longitudinal fold line so that those panels which are on one side of the longitudinal fold line cover the panels which are on the other side of the longitudinal fold line; a layer of adhesive which adheres together two opposed parts of the second pair of panels which are between the weakened tear line and that transverse fold line which is between the first and second pair of panels; and a support web to which one panel of the first pair is adhered so that the said one panel and the other panel of the first pair form a back cover and a front cover respectively for the remaining panels which are enclosed therebetween, and the remaining panels being removable from the front and back covers through the free transverse edge of the front and back covers by tearing along the weakened tear line.

The present invention further provides a method of producing labels, the method comprising the steps of:

(a) producing a longitudinal strip;

(b) forming a weakened tear line transversely across the strip;

(c) folding the strip about a plurality of transverse fold lines which divide the strip into a row of regions such that a first region is covered by the remaining regions and the weakened tear line extends across the second region, the folding being carried out such that that part of the second region which is between the weakened tear line and that transverse fold line which is between the first and second regions is not covered by the following region or regions of the strip;

(d) folding the strip, which has been folded in step (c), about a longitudinal fold line which divides each region into a pair of panels so that those panels which are on one side of the longitudinal fold line cover those panels which are on the other side of the longitudinal fold line, the first-mentioned panel and the second-mentioned panel of the first region forming respectively, front and back covers for the said remaining panels which are enclosed therebetween, and the said part of the second region being divided by the longitudinal fold line and being comprised of two opposed portions;

(e) adhering together the two opposed portions of the said part of the second panel thereby to maintain the strip in a folded configuration; and (f) adhering the back cover to a support web.

BRIEF DESCRIPTION OF THE DRAWINGS

An embodiment of the present invention will now be described by way of example only with reference to the accompany drawings in which.

DESCRIPTION OF THE PREFERRED EMBODIMENTS

Figure 1:
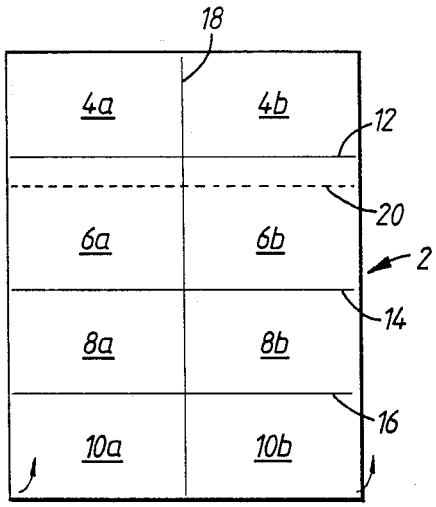
FIG. 1 is a plan view of a strip prepared for folding to form part of a label in accordance with the present invention.
Figure 2A:
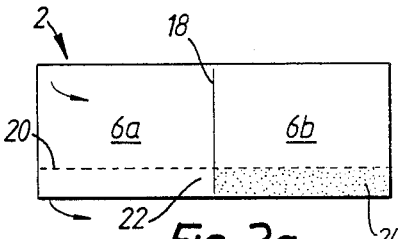
FIGS. 2*a* and 2*b* are each a plan view of the strip of FIG. 1 which has been folded about a plurality of transverse fold lines to a respective alternative folded configuration.
Figure 2B:
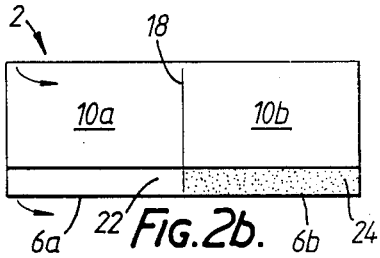

Referring to FIG. 1, a longitudinal strip 2 of paper in the form of a longitudinal strip is divided into a row of pairs of panels 4*a*, 4*b*; 6*a*, 6*b*; 8*a*, 8*b*; 10*a*, 10*b*, by a plurality of transverse fold lines 12, 14, 16 and a longitudinal fold line 18, each fold line extending between the appropriate longitudinal or transverse edges of the strip 2. A weakened tear line 20, e.g. a line of perforation, extends transversely across the second pair of panels 6*a*, 6*b* and parallel to the first transverse fold line 12 which is between the first and second pairs of panels 4*a*, 4*b* and 6*a*, 6*b*. The length in the longitudinal direction of the second pair of panels 6*a*, 6*b*, is greater than that of each other pair of panels 4a, 4b; 8a, 8b; 10a, 10b. The strip 2 is folded about the transverse fold lines 16, 14, 12 to the configuration shown in FIG. 2a or to the configuration shown in FIG. 2b. In FIG. 2a the strip 2 has been folded in turn and in the same direction about the transverse fold lines 16, 14, 12 whereby the folded strip is in the form of a flattened tube. In FIG. 2b, the strip 2 has been folded about the transverse fold lines 12, 14, 16 about alternately opposing directions whereby the folded strip is in the form of a concertina. The panels of the strip 2 are dimensioned so that after the strip 2 has been folded in either of the manners as described above that portion 22 of the second pair of panels 6a, 6b which is between the weakened tear line 20 and the first transverse fold line 12 is exposed and is not covered by the following pairs of panels of the strip. In the arrangement of FIG. 2a this is achieved since the following pairs of panels are enclosed between the first and second pairs of panels 4a, 4b and 6a, 6b whereby the second pair of panels 6a, 6b is disposed on the outside of the flattened tube. In the arrangement of FIG. 2b this is achieved since the second pair of panels 6a, 6b is longer in the longitudinal direction than the following pairs of panels whereby those following pairs of panels do not cover the said portion 22 of the second pairs of panels. Preferably, as is shown in FIG. 2b, the second pair of panels 6a, 6b is longer than the following panels by a distance which is equal to the length of the said portion 22 whereby the lower edge of the following panels is aligned with the weakened tear line 20.

Figure 3:
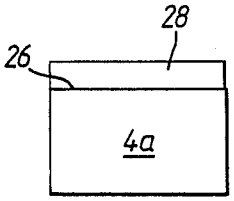
FIG. 3 is a plan view of the folded strip of either of FIGS. 2*a* and 2*b* which has been further folded about a longitudinal fold line.
Figure 4:
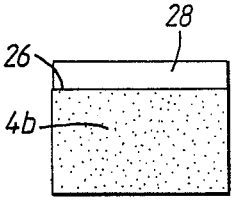
FIG. 4 is a plan view of the rear of the folded strip of FIG. 3.

As is shown in FIGS. 2a and 2b, at least one part of the portion 22 is coated with a layer of adhesive 24, e.g. a water soluble adhesive. The strip 2 is folded about the longitudinal fold line 18 so that that part of the folded strip 2 which is on one side of the longitudinal fold line 18 covers that part of the folded strip 2 which is on the other side of the longitudinal fold line 18. The two opposed parts of the portion 22 are adhered together by the layer of adhesive 24 thereby to maintain the strip in its folded configuration. FIG. 3 shows the front of the folded strip 2 in which the panel 4a forms the front cover and FIG. 4 shows the back of the folded strip 2 in which the panel 4b forms the back cover. The remaining panels extend above the transverse end edge 26 of the front and back covers 4a, 4b, since the second pair of panels 6a, 6b is longer in the longitudinal direction than the front and back covers 4a, 4b, to form an exposed tab portion 28.

Figure 5:
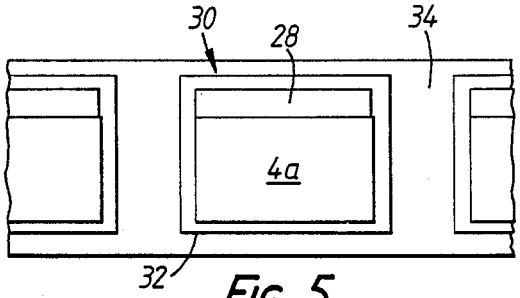
FIG. 5 is a plan view of a plurality of labels in accordance with the present invention when carried on a backing of a release material, each label incorporating one of the folded strips of FIGS. 3 and 4.
Figure 6:
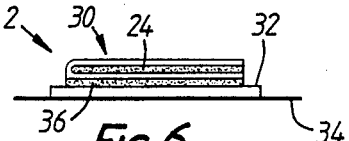
FIG. 6 is a side view of the lower edge of the label of FIG. 5.

FIGS. 5 and 6 show a label 30 in accordance with the invention. The label 30 comprises a support web 32 which is self-adhesive on its rear face and is carried on a backing of a release material 34. The folded strip of FIGS. 3 and 4 is adhered by the back cover 4b thereof to the support web 32 by a second layer of adhesive 36. In the preferred form of the present invention, a plurality of labels 30 are carried in succession on a length of the backing of release material 34 which is wound on to a reel. The labels 30 may be peeled off the release material 34 for application to products to be labelled. The reel can be inserted into an automatic labelling machine which can automatically apply the self-adhesive labels to products to be labelled.

The label of the present invention includes a sheet portion, which is constituted by panels 8a, 8b; 10a, 10b and those parts of panels 6a and 6b which are on the same side of the weakened tear line 20 as those panels, which is enclosed within an envelope portion which is constituted by the front and back covers 4a and 4b and the remaining parts of panels 6a and 6b. When it is desired to remove the sheet portion from the envelope portion, in order to read information which is printed thereon relating to the product which is labelled, a user simply manually pulls upwardly the exposed tab portion 28 of the sheet portion. This causes the strip 2 to tear along the weakened tear line 20 and permit the sheet portion to be supported and removed from the envelope portion. It can then be unfolded and read by the user. If desired, after use the sheet portion can be re-folded and re-inserted back into the envelope portion for safe-keeping until it is required at a later time.

The labels of the present invention are made by providing the longitudinal strip 2, forming the weakened tear line 20 transversely across th strip 2 preferably by means of a perforator, folding the strip 2 about the transverse fold lines 12, 14, 16 in the manner described above, applying the layer of adhesive 24 to the said at least one part of the portion 22 of the second pair of panels 6a, 6b the adhesive application being carried out either before or after the above-specified folding step, folding the folded strip about the longitudinal fold line 18 and then adhering the back cover 4b to the support web 32 by the second layer of adhesive 36. Typically, the perforating, folding, adhesive applying and folding steps are carried out continuously in-line in the required order by means of an appropriately modified automatic folding machine which incorporates a perforator and an adhesive applicator. The folded and adhered strips 2 may be adhered to the support webs 4 by the methods which are described in my British patent Specification No. 2,127,378 entitled "Method of Producing Labels". In a particularly preferred arrangement, the various steps of the method of the present invention are carried out in a continuous in-line process, which results in an efficient and cost-effective method of producing labels.

Since the method of the present invention does not require the longitudinal strips to be die-cut, since they are a simple rectangular shape, then the longitudinal strips can be fed directly from a printing station at which they are printed on both sides to the automatic folding machine at which they are perforated, folded, folded again and adhered in-line in a continuous manner, and then fed directly to a folded sheet applying station at which they are continuously applied to a succession of support webs.

What I claim is:

1. A label for attachment to a product, the label comprising a longitudinal strip which is divided into a row of pairs of panels by a plurality of transverse fold lines and a longitudinal fold line, the row including a first pair of panels at an end of the strip and a second pair of panels adjacent to the first pair of panels, the strip having a transverse weakened tear line which extends across the second pair of panels, the weakened tear line dividing the strip into a first portion, which includes the first pair of panels and part of the second pair of panels, and a second portion comprising the remainder of the strip, the strip being folded about the transverse fold lines such that the first pair of panels is covered by the remaining pairs of panels and then about the longitudinal fold line so that those panels which are on one side of the longitudinal fold line cover the panels which are on the other side of the longitudinal fold line; a layer of adhesive which adheres together two opposed parts of the second pair of panels which are between the weakened tear line and that transverse fold line which is between the first and second pair of panels; and a support web to which one panel of the first pair is adhered so that the said one panel and the other panel of the first pair form a back cover and a front cover respectively for the remaining panels which are enclosed therebetween, and the second portion of the strip being removable from the front and back covers and the said two opposed parts of the second pair of panels by tearing along the weakened tear line.

2. A label according to claim 1 wherein the length in the longitudinal direction of the second pair of panels is greater than that of each other pair of panels whereby the said remaining panels extend above the transverse end edges of the front and back covers.

3. A label according to claim 2 wherein the rear face of the support web is self-adhesive and is carried on a backing of a release material.

4. A method of producing labels, the method comprising the steps of:

(a) producing a longitudinal strip;

(b) forming a weakened tear line transversely across the strip;

(c) folding the strip about a plurality of transverse fold lines which divide the strip into a row of regions such that a first region is covered by the remaining regions and the weakened tear line extends across the second region, the folding being carried out such that that part of the second region which is between the weakened tear line and that transverse fold line which is between the first and second regions is not covered by the following region or regions of the strip;

(d) folding the strip, which has been folded in step (c), about a longitudinal fold line which divides each region into a pair of panels so that those panels which are on one side of the longitudinal fold line are the first panels to cover those panels which are on the other side of the longitudinal fold line, which are the second panels, the first-mentioned panel and the second-mentioned panel of the first region forming respectively, front and back covers for the said remaining panels which are enclosed therebetween, and the said part of the second region being divided by the longitudinal fold line and being comprised of two opposed portions;

(e) adhering together the two opposed portions of the said part of the second panel thereby to maintain the strip in a folded configuration; and (f) adhering the back cover to a support web.

5. A method according to claim 4 wherein the length in the longitudinal direction of the second pair of panels of the second region is greater than that of each other pair of panels whereby in the resultant label the said remaining regions extend above the transverse end edges of the front and back covers.

6. A method according to claim 5 wherein the rear face of the support web is self-adhesive and is carried on a backing of a release material.

* * * * *